United States Patent [19]

Haysom

[11] Patent Number: 4,846,471

[45] Date of Patent: Jul. 11, 1989

[54] METHOD FOR USE IN THE TRAINING AND WARMING-UP OF BASEBALL PITCHERS

[76] Inventor: Elbert M. Haysom, 1527 San Carlos, Orange, Calif. 92665

[21] Appl. No.: 903,967

[22] Filed: Sep. 4, 1986

[51] Int. Cl.[4] ..... A63B 69/40

[52] U.S. Cl. ..... 273/26 E; 273/26 R; 273/58 C

[58] Field of Search ..... 273/26 E, 29 A, 189 R, 273/261, 54 R, 58 C, 26 C, 28; 272/125, 135, 136, 137, 106, 107, 108, 82; 434/247

[56] References Cited

U.S. PATENT DOCUMENTS

| | | | |
|---|---|---|---|
| 667,563 | 2/1901 | Oakley . | |
| 795,960 | 8/1905 | Cook | 273/58 C |
| 2,765,170 | 10/1956 | Brown | 273/26 |
| 2,848,234 | 8/1958 | Brandon | 273/35 |
| 3,153,537 | 10/1964 | Lewis | 273/26 |
| 3,214,166 | 10/1965 | Gaudet | 273/26 E |
| 3,297,321 | 1/1967 | Kuhnes et al. | 273/26 |
| 3,469,840 | 9/1969 | Kruzel | 273/26 |
| 3,618,942 | 11/1971 | Bates | 272/82 |
| 3,652,085 | 3/1972 | Cole | 273/26 R |
| 4,042,241 | 8/1977 | Collins | 273/58 C |

FOREIGN PATENT DOCUMENTS

| | | | |
|---|---|---|---|
| 1357 | of 1903 | United Kingdom | 272/136 |
| 2148136 | 5/1985 | United Kingdom | 272/136 |

OTHER PUBLICATIONS

Haysom et al., "The First Pitching Book", p. 6.

*Primary Examiner*—Edward M. Coven
*Assistant Examiner*—T. Brown
*Attorney, Agent, or Firm*—Richard L. Gausewitz

[57] ABSTRACT

A method for training and warming-up baseball pitchers, using an apparatus comprising a closed loop of stretchable cord having a baseball or a simulated baseball mounted thereon. In accordance with one aspect of the method, the cord is secured to an anchor point spaced above the ground, and the pitcher slowly performs a simulated pitching movement while standing with his back to the anchor point and at a distance therefrom determined by the desired tension in the cord. In accordance with another aspect of the method, the pitching motion is performed without turning the pitching arm and wrist, and it is ascertained whether turning has occurred by sensing whether or not the upper fingers of the gripping hand of the pitcher engage portions of the cord at the baseball.

3 Claims, 3 Drawing Sheets

METHOD FOR USE IN THE TRAINING AND WARMING-UP OF BASEBALL PITCHERS

BACKGROUND OF THE INVENTION

There has previously been provided an apparatus for use in the training and warming-up of baseball pitchers. Such apparatus is a baseball secured, at a single point of connection, to an elastic cord that is connected to one end of a stick. The stick is held behind the back of the pitcher, in contact with the back and angling downwardly so that the nonpitching hand can hold the other end of the stick. The pitcher grips the baseball with his pitching hand, and moves his pitching arm in stretching the training motions.

In the above-indicated apparatus, the connection to the baseball is a metallic connection means, including an eye, the shank of which extends into the baseball. Other prior-art workers have proposed different means of connecting elastic cords to baseballs and other balls. These have included, for example, a stopper inserted in a bore in a baseball.

SUMMARY OF THE INVENTION

According to one aspect of the present invention, an elastic cord is connected to a baseball at two spaced-apart points that are preferably diametrically opposite each other. Then, a training method is practiced by which a simulated throwing motion is performed, very slowly, and the wrist is at all times so turned that the baseball-gripping fingers do not contact the cord. This not only stretches, strengthens and warms up the pitching arm in the safest way, but also develops muscle memory tending strongly to prevent the pitcher from twisting his arm and wrist when actually pitching. This is believed to reduce the tendency of young pitchers to develop such arm problems as Little League elbow.

According to another aspect of the invention, the elastic cord is secured not to a stick but to a fence, a post, or other stationary object of appropriate height. The pitcher then moves a distance, from the stationary object, that is correlated to the strength of his arm and to the particular point in the training or pre-game routine. For example, if the pitcher is strong, and/or if a substantial amount of training or pregame activity with the present apparatus has already occurred, the pitcher can move farther from the stationary object (but not sufficiently far to risk injury to his arm or damage to the apparatus).

According to another aspect of the invention, an elongate and substantially closed-loop cord is provided in combination with a baseball or simulated baseball, one portion of the substantially closed loop extending into and out of the baseball at opposite sides thereof.

According to another aspect of the invention, an apparatus and method are provided for effectively securing opposite ends of rubber tubing in a bore through a baseball or simulated baseball, thus providing the function and appearance of a closed and connection-free closed-loop apparatus.

DETAILED DESCRIPTION OF THE PREFERRED EMBODIMENT

In the present specification and claims, the words "elastic cord" are used in their broader sense to include elongated, highly flexible and elastic elements whether or not they incorporate numerous fibers or strands. In the greatly preferred form, the cord is a homogeneous elastomeric tube, preferably natural rubber latex tubing.

Figure 1:
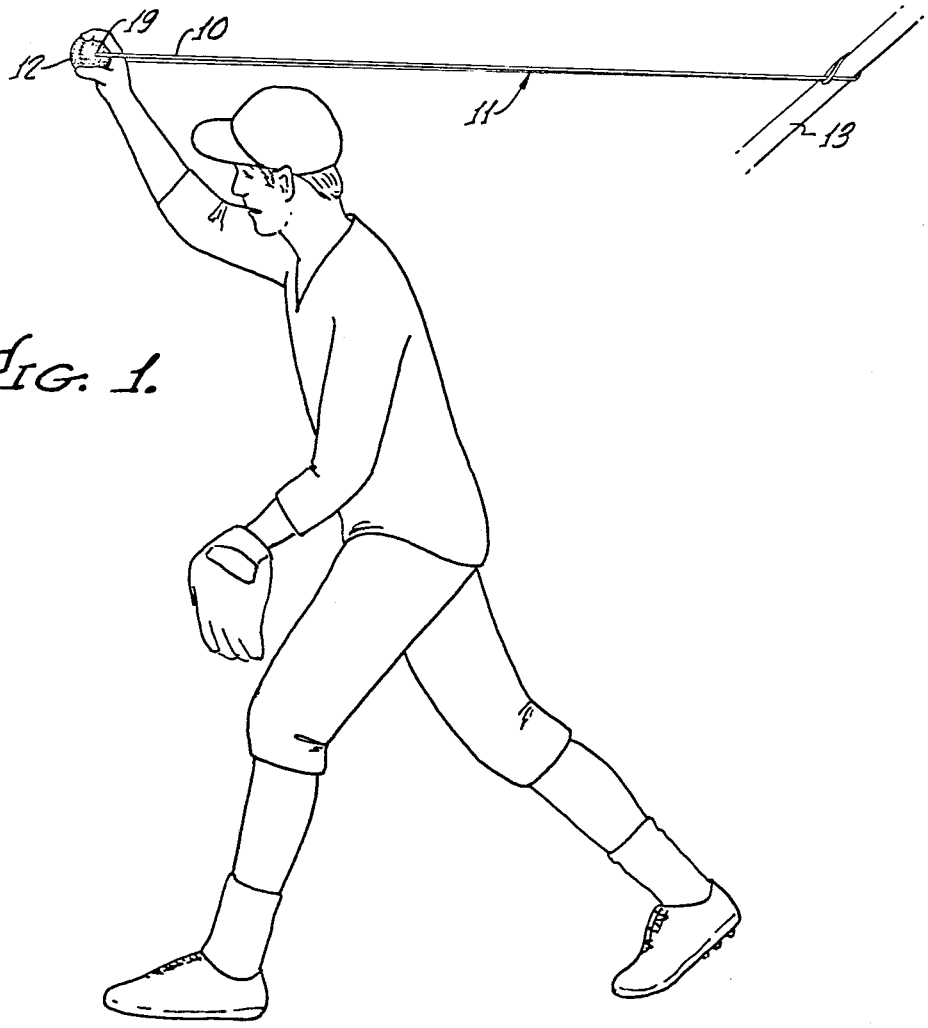
FIG. 1 is an elevational view showing a pitcher performing the present method, at a later stage of the method when the pitching hand has started to pivot forwardly about a horizontal axis located at the wrist.
Figure 2:
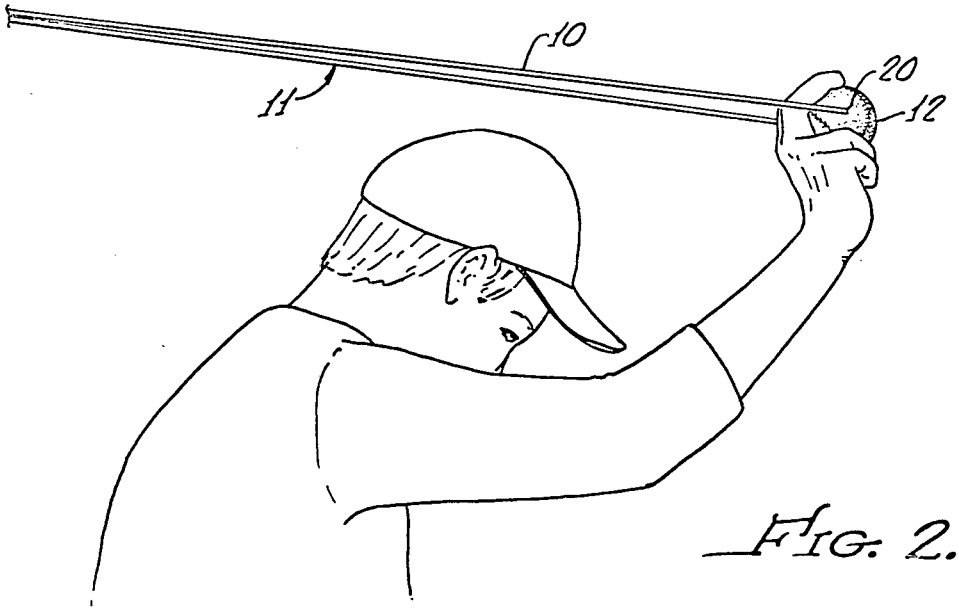
FIG. 2 is a somewhat larger elevational view showing only the upper portion of the pitcher, such pitcher performing the method and at an earlier stage before the pitching hand has begun to pivot forwardly.
Figure 3:
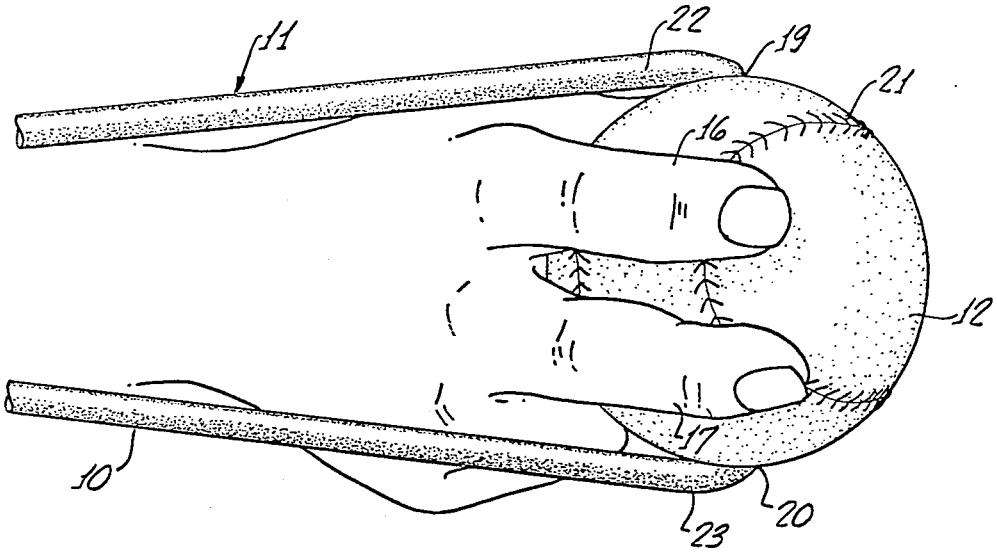
FIG. 3 is an enlarged view showing only the hand, ball and connected ends of the elastic cord, as viewed from the right in FIG. 1 or the left in FIG. 2.

Referring to FIGS. 1–3, inclusive, a substantial length of cord 10 is formed into a closed loop 11 and is associated with the baseball 12 on opposite sides of such baseball, preferably at two poles thereof as shown in FIG. 3. The portion of closed loop 11 that connects to baseball 12 is shown in FIG. 2. The remaining portion of closed loop 11 is secured to a stationary object as indicated at the right in FIG. 1. In such FIG. 1, the end of the closed loop remote from baseball 12 is secured to the stationary object, in this case a horizontal bar 13 of a conventional chain-link fence having vertical posts extended into the ground, and also having chain and horizontal bars such as 13.

Very preferably, and as described subsequently, the ends of the cord 10 in the closed loop 11 are associated with each other interiorly of baseball 12, so that the entire apparatus performs the function of and gives the appearance of a continuous length of cord that is integrally looped. To connect the loop to a stationary object such as fence bar 13, the end portion of the loop is inserted through the fence and around the bar, following which the baseball is inserted through such loop end portion and pulled to create a hitch.

The length of the cord 10 is substantial, preferably between four and five feet when the cord is in its relaxed condition. Accordingly, the closed loop 11 is somewhat over two feet in length, when the cord is relaxed, but certain other lengths—for example, somewhat longer—are satisfactory.

There will next be described the method of performing training and warming-up procedures while employing the present apparatus. The method will be described relative to conventional baseball (hardball), but it is to be understood that the present apparatus and method may also be employed relative to softball. When employed for softball, the apparatus is connected to a stationary object at a much lower elevation than is indicated in FIG. 1, and the method is performed while the pitcher has his or her arm extended downwardly in a softballpitching position.

The present apparatus and method may be employed relative to pitchers of all ages. However, certain aspects of the method are especially important relative to pitchers of appropriate ages for performing in such organizations as Little League. In particular, it is an important object of one aspect of the present invention to minimize the tendency for the pitcher to develop arm problems such as Little League elbow, such problems being related to the fact the arm of the boy or girl doing the pitching has not fully matured.

To perform the method relative to conventional baseball, the loop is secured to some sturdy stationary object such as the indicated chain-link fence. The height of the connection point is preferably about the same as that of the head of the pitcher, or a small amount higher. The pitcher then grips the baseball 12 and moves to such a distance from the stationary object that the elastic loop 11 will be stretched to a desired extent during movement of his or her arm through a motion that simulates throwing or pitching but is greatly slower. The pitcher stands with his or her back to the fence or other loop-anchor point.

In accordance with one aspect of the method, the pitcher can move farther and farther from the stationary object as he or she becomes more warmed-up. Furthermore, stronger pitchers can stand farther from the stationary object than do less mature or strong pitchers. In all cases, however, the distance from the pitcher's hand to the anchor point on the stationary object is caused to be sufficiently small that there will be minimal risk to injury to the arm, and minimal danger that the cord 10 may break.

The pitcher grips the baseball 12 with a normal, comfortable pitching grip, and stands in a conventional pre-pitch position the desired distance from the fence or other anchor point. He or she then, very slowly, move his or her arm forwardly and downwardly in a pitching or throwing motion. At the beginning of the motion, the wrist is cocked upwardly as shown in FIG. 2, while during the latter stages of the motion the wrist is caused to pivot so that the hand pivots forwardly as indicated generally in FIG. 1.

As above indicated, the method is performed slowly, especially at the beginning, so as to stretch the muscles. After initial stretching, the method is performed at a rate of, preferably, about ten simulated throws or pitches per minute.

At the latter portions of each simulated pitch or throw, one leg (the left leg for a right-handed pitcher) is moved forwardly, with knee somewhat bent, so as to simulate certain portions of the latter stages of an actual pitch or throw. This is shown in FIG. 1. It is pointed out that, when the present method is performed, there is less strain on the forward leg than actually occurs when a ball is being thrown during a game. This is because there is no jarring of the knee when the front foot comes down onto the ground.

The present method can reduce the need for the conventional warm-up during which balls are thrown to a catcher. This can be especially important during certain nonprofessional games when warm-up catchers may not be available, so that the pitcher sometimes goes into the game without adequate preparation.

The present method is useful not only for training the arm, and for warm-up, but to rehabilitate arms that have not been used for a substantial period of time. It is emphasized that if the arm hurts, the present method should not be performed, just as actual throwing and pitching should not be performed when the arm hurts.

It is greatly preferred that the baseball 12 be a real one, so that the pitcher is aided in becoming comfortable with the ball, gripping the seams, etc. However, certain of the claims encompass using a simulated baseball.

When the apparatus and method are performed relative to softball instead of hardball, the looped end remote from the softball is secured at a height that is normally about the same as that of a door knob. Furthermore, the apparatus is caused to incorporate a ball having the same size and feel as that of a regulation softball. Then, the method is performed with the hand pointing downwardly, just as is the case relative to softball pitching. As in the case relative to hardball, the method is performed slowly, especially at first.

The loop may extend through the baseball or softball at different points relative to the seam, so as to accommodate pitchers who prefer to use certain types of grips during the training and warm-up procedure of the present invention.

The method as thus-far described helps to build proper throwing muscles in the forearm of the pitcher, as well as building the throwing muscles in the shoulders. In addition, the strength of the wrist is increased as is the strength of the grip on the baseball. Stated otherwise, the fingers rae strengthened for throwing and pitching.

Because the method is performed while using a desired grip, the method aids the pitcher in "building" a desired grip position.

Very importantly, muscle memory is developed for proper throwing and pitching. "Muscle memory" may be defined as a condition, produced by practice, where the muscles react consistently and automatically to messages sent from the brain.

The method also can increase the range of motion of the pitcher's arm.

It is greatly preferred that the method be performed, as described above, by anchoring one end of the loop to a stationary object. This achieves numerous important advantages, in addition to the one whereby the tension of the loop may be varied, as desired, by moving nearer to or farther from the stationary object. Another advantage is that the left hand of the pitcher (assuming the pitcher is right-handed) may hang naturally, as shown in FIG. 1, as the pitching arm, shoulder, hand and fingers are developed. Furthermore, in the remote event that the cord 10 breaks, the broken ends will normally snap back towards the anchor at 13, far from the head of the pitcher.

It is, however, pointed out that the present apparatus is not useless if no stationary object happens to be present or convenient at a particular baseball field. It is possible to cause the loop to bend downwardly over the pitching shoulder, and then to cause the left hand of the pitcher (assuming he or she is right-handed) to hold the loop end remote from baseball 12. Then, stretching and simulated pitching and throwing motions are slowly performed.

The above portions of the specification relate substantially entirely to performance of the method by substantially all pitchers of whatever age. There will next be described an aspect of the method that is particularly useful relative to young pitchers who are in the danger of developing such arm problems as Little League elbow.

Referring to FIG. 3, it is pointed out that the baseball 12 can and should be gripped in a normal, comfortable position at which neither the index finger 16 nor the middle finger 17 is in engagement with any portion of loop 11. This is true even if the baseball is gripped at another position relative to the seam, provided an apparatus is employed wherein the cord 10 meets the outer surface of baseball 12 at points (numbered 19 and 20 in FIGS. 3 and 4) that are properly oriented relative to the seam 21. It is the opinion of applicant that young pitchers, having undeveloped and immature arms, should not rotate their arms and wrists during training or playing. The present method and apparatus make is extremely simple for the pitcher to know when the arm and wrist are being rotated in any substantial degree.

When the method of training, warm-up, etc., is performed properly by pitchers having immature arms, the fingers 16, 17 remain generally as shown relative to the cord regions 22, 23 (FIGS. 3 and 4) that are spaced slightly from the points 19, 20 at which the cord is associated with opposite sides (preferably, diametrically-opposite side portions) of the baseball. Stated otherwise, neither finger touches either cord portion 22 or 23 at any point in the training and warm-up motion described above.

Figure 4:
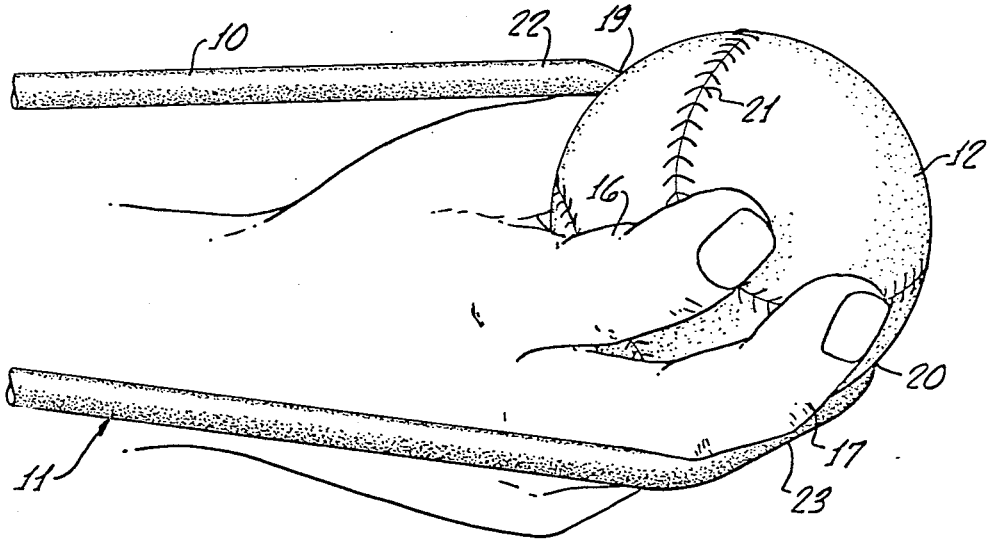
FIG. 4 is a view corresponding to FIG. 3 but showing an incorrect wrist and hand position.

Referring next to FIG. 4, the condition is shown at which the arm and wrist have been turned until middle finger 17 engages cord region 23. This indicates to the pitcher that his or her arm and wrist have been turned excessively, and that the training and warm-up motion is not the proper one. The same condition would occur if index finger 16 were to contact cord portion 22 due to twisting of the arm and wrist in the opposite direction.

Thus, in a very simple and effective manner which is not dependent upon the eyes of the pitcher, but instead can instantly be sensed by the pitcher due to his or her sense of feel, the pitcher knows whether the pitching movement is correct vis-a-vis prevention of rotation of the wrist and arm. By performing the simulated pitching or throwing movement many times, muscle memory is developed that minimizes the tendency for the pitcher to twist his or her arm and wrist during actual playing.

Figure 5:
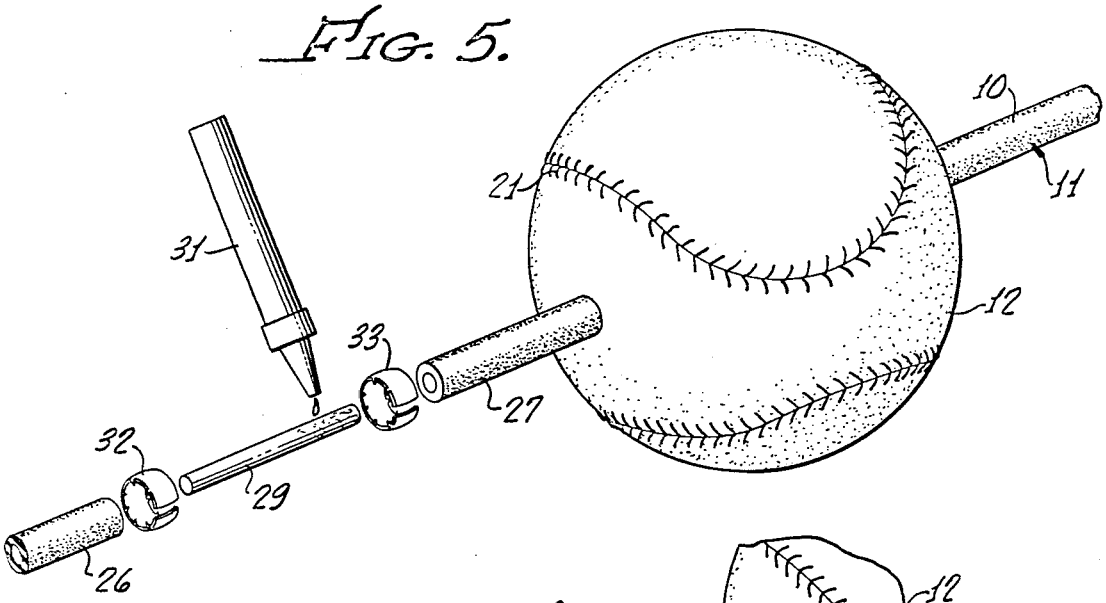
FIG. 5 is an exploded view illustrating the method for mounting the baseball on opposed ends of a closed-loop elastic cord.

There will next be described, relative to FIGS. 5–7, the method and apparatus for securing opposite ends of cord 10 inside baseball 12, the connection being totally concealed by the baseball so that the apparatus gives the function and appearance of a single integral closed-loop cord 10 having a baseball 12 mounted thereon.

As indicated above, the greatly preferred cord material is natural rubber latex tubing. To securely associate the ends 26, 27 of tubing 10 to each other and to baseball 12 interiorly of the latter, the following method is performed and apparatus employed.

In such description, the preferred dimensions of the cords will be stated, but it is to be understood that certain other sizes may be employed in accordance with factors such as tubing diameter and tubing hole size.

A hole is drilled diametrically through the baseball 12 to form a bore 28 (FIG. 7) of predetermined size, preferably onequarter inch. The end portion 27 of the elastomeric tube, having a one-quarter inch outer diameter and a one-eighth inch inner diameter, is connected to a wire, preferably by means of a barb on the end of the wire. The wire is then threaded through the bore without causing any portion of the tubing to enter the bore. Then, the wire is pulled in a direction away from the tubing, while the tubing is gripped at a region spaced from the end portion 27 thereof, to cause the tubing to stretch and thus reduce in diameter. The thus-stretched tubing is then caused to move through the bore so that the end 27 protrudes outwardly from the bore as shown in FIG. 5.

Thereafter, the wire is disconnected from the tube end 27 and an externally-glued elongated dowel 29, one-eighth inch in diameter, is inserted into the tube end 27 for a distance approximately equal to half the length of the dowel. The apparatus for applying glue or adhesive to the dowel is indicated schematically at 31 in FIGS. 5 and 6.

The remaining end 26 of cord 10 is then moved so as to be telescoped over the protruding end of dowel 29. Thereafter, clamps 32, 33 are mounted around the respective tube ends 26, 27 radially adjacent dowel 29. The degree of clamping is caused to be such that the external surfaces of the clamps 32, 33 are recessed below the exterior surfaces of tube ends 26, 27, as shown in FIG. 7, a certain amount of tubing flowing longitudinally of the dowel to permit this to occur.

Figure 6:
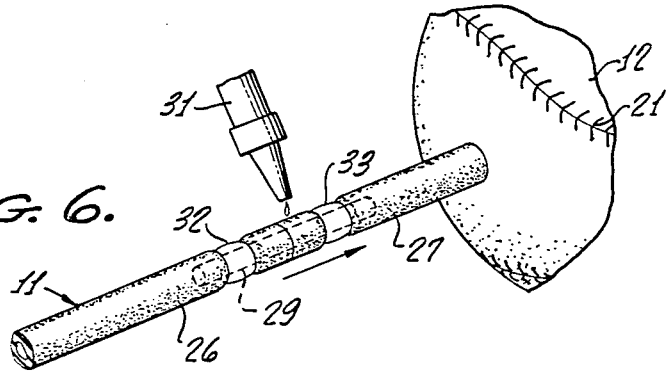
FIG. 6 corresponds to FIG. 5 but shows the positions of the parts at a late stage in the process.
Figure 7:
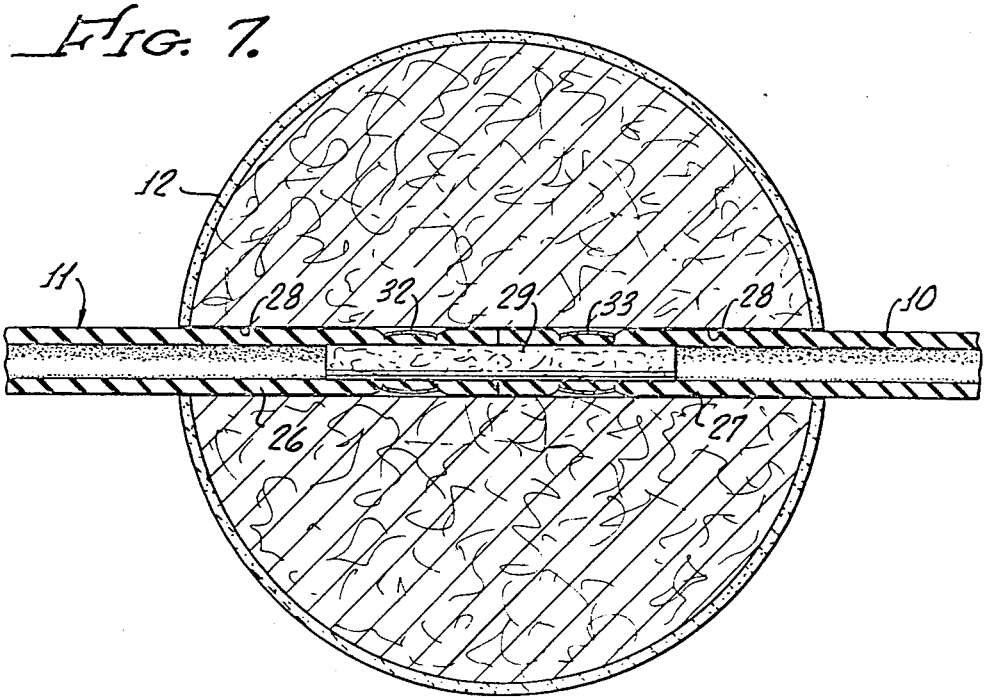
FIG. 7 is an enlarged sectional view taken through the baseball and illustrating the connected cord ends therein.

Thereafter, glue is applied to the exterior of the tube ends 26, 27, for example by the apparatus 31 as shown in FIG. 6, the cord 10 is longitudinally stretched on opposite sides of the point, and the joint is shifted into the bore 28 until (preferably) in the central position illustrated in FIG. 7. As a final step, adhesive may be caused to enter the bore ends around the tube regions inserted therein.

Thus, the tubing is adhered to the dowel by adhesive and, preferably, by the clamps 32, 33 also. Furthermore, the tubing is adhesively adhered to the interior wall of baseball 12 defining the bore 28.

It is preferred to employ low-viscosity adhesive that is quick drying. Furthermore, it is preferred to employ a baseball having a core made of a composite of rubber and cork. It is pointed out that by employing the clamps 32, 33, the joint is not only strengthened but the process is caused to be more rapidly performable even if the adhesive is not extremely quick drying. This is because the tube ends will not pull off of the dowel 29 when the tubing is stretched for insertion into the final position shown in FIG. 7.

The word "cord", in the present specification and claims, encompasses a helical tension spring.

The baseball has a circumference of substantially 9 inches, whereas the softball has a circumference of substantially 12 inches. These are regulation sizes.

The foregoing detailed description is to be clearly understood as given by way of illustration and example only, the spirit and scope of this invention being limited solely by the appended claims.

What is claimed is:

1. A method of training a relatively young baseball pitcher to pitch without twisting his or her arm and wrist, said method comprising:

(a) providing first and second sections of flexible elastic stretchable cord that connects to opposite sides of a spherical object in the nature of a baseball, (b) holding the end of the cord, remote from said baseball, so as to prevent substantial movement of said remote end, (c) gripping said baseball with a pitching grip, in such relationship to said first and second cord sections that the upper fingers of the pitcher do not touch either of said sections, (d) simulating a pitching movement while said baseball is thus gripped, while standing with the back toward said remote end of said cord, and while attempting to prevent the arm and hand from rotating, and (e) employing, as an indication of failure to perform said simulation step (d) properly, the fact that said upper fingers come into contact with one of said first and second cord sections at opposite sides of said baseball.

2. The invention as claimed in claim 1, in which said method further comprises causing said cord sections on opposite sides of said baseball to be portions of first and second elongated cord sections that extend from said baseball for a distance of a few feet.

3. The invention as claimed in claim 2, in which said method further comprises causing said cord sections to be parts of a continuous loop, and in which said method further comprises connecting the portion of said cord remote from said baseball to a stationary object at a substantial height above the ground, said substantial height being substantially that of the head of the person performing the method.

* * * * *